US005704686A

United States Patent [19]

May

[11] Patent Number: 5,704,686

[45] Date of Patent: Jan. 6, 1998

[54] GLIDING RECLINING CHAIR

[75] Inventor: Teddy J. May, Tupelo, Miss.

[73] Assignee: The Lane Company, Inc., Altavista, Va.

[21] Appl. No.: 666,655

[22] Filed: Jun. 18, 1996

Related U.S. Application Data

[60] Provisional application No. 60/005,330 Oct. 17, 1995.

[51] Int. Cl.[6] ..... A47D 13/10

[52] U.S. Cl. ..... 297/281; 297/273; 297/85

[58] Field of Search ..... 297/273, 85, 84, 297/33, 281, 68, 271, 270

[56] References Cited

U.S. PATENT DOCUMENTS 3,226,155 12/1965 Whiteford ..... 297/85
4,544,201 10/1985 Rogers, Jr. .
4,591,205 5/1986 James ..... 297/85
5,186,518 2/1993 Pine ..... 297/85
5,427,433 6/1995 Holobaugh, Jr. ..... 297/273

*Primary Examiner*—Laurie K. Cranmer
*Attorney, Agent, or Firm*—Cushman Darby & Cushman Intellectual Property Group of Pillsbury Madison & Sutro LLP

[57] ABSTRACT

A gliding reclining chair has a base, on which a preferably three-position recliner chair mechanism is suspended by two short glider links on each side. The upper and lower pivot joints of the glider links are ball bearing-type joints, for ease of gliding. As the legrest is extended, associated links engage stops provided on the base and glider links for preventing gliding. The handle for thrusting and retracting the legrest interconnects and associates the two side linkages, so that they act in coordination.

3 Claims, 16 Drawing Sheets

GLIDING RECLINING CHAIR

REFERENCE TO RELATED APPLICATION

This is based on provisional application Ser. No. 60/005,330, filed Oct. 17, 1995.

BACKGROUND OF THE INVENTION

Most 3-position reclining chairs which are also rockers include rocker cams on which the chair mechanism is mounted. The rocker cams are supported on rails or rail regions of a base, and locks are usually provided for restricting or preventing rocking of the rocker cams on the rails if the legrest has been thrust sufficiently to lift the user's feet off the floor.

The rocker cams on rails provides a distinctive arc to the rocking motion of the user in the chair. The conventional rocking motion imposes restrictions on styling, including seat height. To some users or potential users, the flatter arching motion provided by a porch glider is more comfortable and less disconcerting than the motion provided by rocker cams rocking on rails or another flat surface. A shorter user can glide without their feet being lifted from the floor.

The rocker locks conventionally provided on rocker recliners often involve linkages which must pivot when the chair is meant to rock, or landing gear that can disconcertingly engage the base.

SUMMARY OF THE INVENTION

A gliding reclining chair has a base, on which a preferably three-position recliner chair mechanism is suspended by two short glider links on each side. The upper and lower pivot joints of the glider links are ball bearing-type joints, for ease of gliding. As the legrest is extended, associated links engage stops provided on the base and glider links for preventing gliding. The handle for thrusting and retracting the legrest interconnects and associates the two side linkages, so that they act in coordination.

The principles of the invention will be further discussed with reference to the drawings wherein preferred embodiments are shown. The specifics illustrated in the drawings are intended to exemplify, rather than limit, aspects of the invention as defined in the claims.

BRIEF DESCRIPTION OF THE DRAWINGS

In the drawings:

FIG. 2 is a longitudinal sectional view of the chair, looking from the omitted right side at the inner face of the left side, with the legrest fully retracted and the suspended structure of the chair at its natural rest position;

FIG. 3 is a perspective view of the chair from the right and above, in its FIG. 2 position;

FIG. 4 is a larger scale fragmentary perspective view of a portion of the chair as shown in FIG. 3;

FIG. 5 is a perspective view of the chair from the left and above, in its FIG. 2 position;

FIG. 6 is a rear elevational view of the chair in its FIG. 2 position;

FIG. 7 is a perspective view of the chair from the rear, from a more elevated viewpoint than FIG. 6, showing the chair in its FIG. 2 position;

FIG. 8 is a view similar to FIG. 2, but showing suspended structure of the chair fully glided backward;

FIG. 9 is a view similar to FIG. 2, but showing the suspended structure of the chair fully glided forward;

FIG. 10 is a longitudinal sectional view of the chair, looking from the omitted right side at the inner face of the left side, with the legrest fully extended, the back erect, and glide blocked, in the intermediate, TV position which is also depicted in FIG. 1;

FIG. 11 is a perspective view similar to FIG. 3, but showing the chair in its FIG. 1 position;

FIG. 12 is a larger scale fragmentary perspective view of a portion of the chair as shown in FIG. 11;

FIG. 13 is a perspective view similar to FIG. 5, but showing the chair in its FIG. 1 position;

FIG. 14 is a top plan view of the chair in its FIG. 1 position;

FIG. 15 is a perspective view similar to FIG. 7, but showing the chair in its FIG. 1 position; and FIG. 16 is a longitudinal sectional view of the chair, similar to FIGS. 2, 8, 9 and 10, but showing the chair with the legrest fully extended and the back fully reclined.

DETAILED DESCRIPTION

Figure 1:
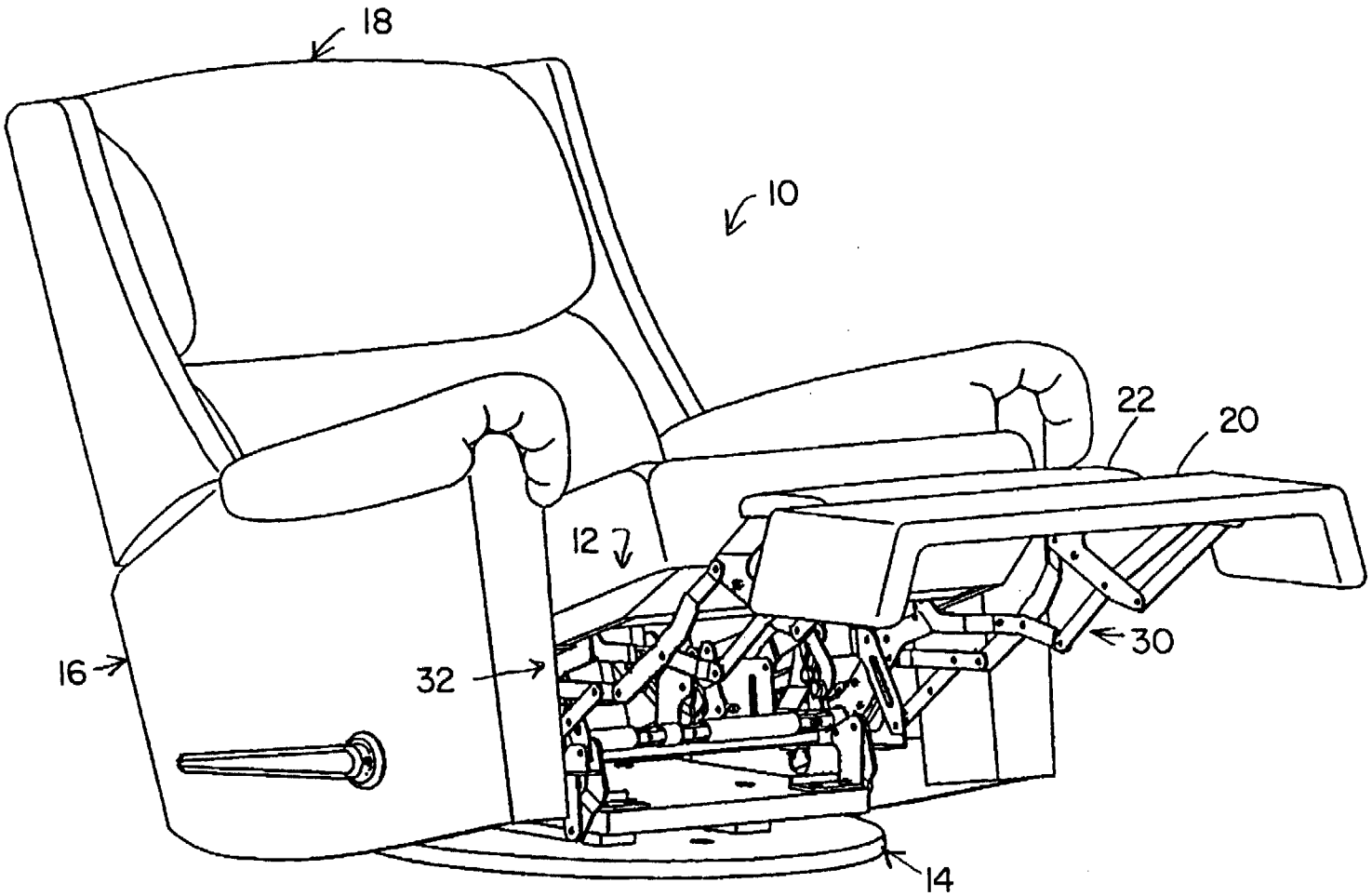
FIG. 1 is a perspective view of a gliding reclining chair embodying a preferred embodiment of the present invention, shown from the front and right side, with the legrest fully extended, and the backrest erect, in the intermediate, TV position of the chair.
Figure 2:
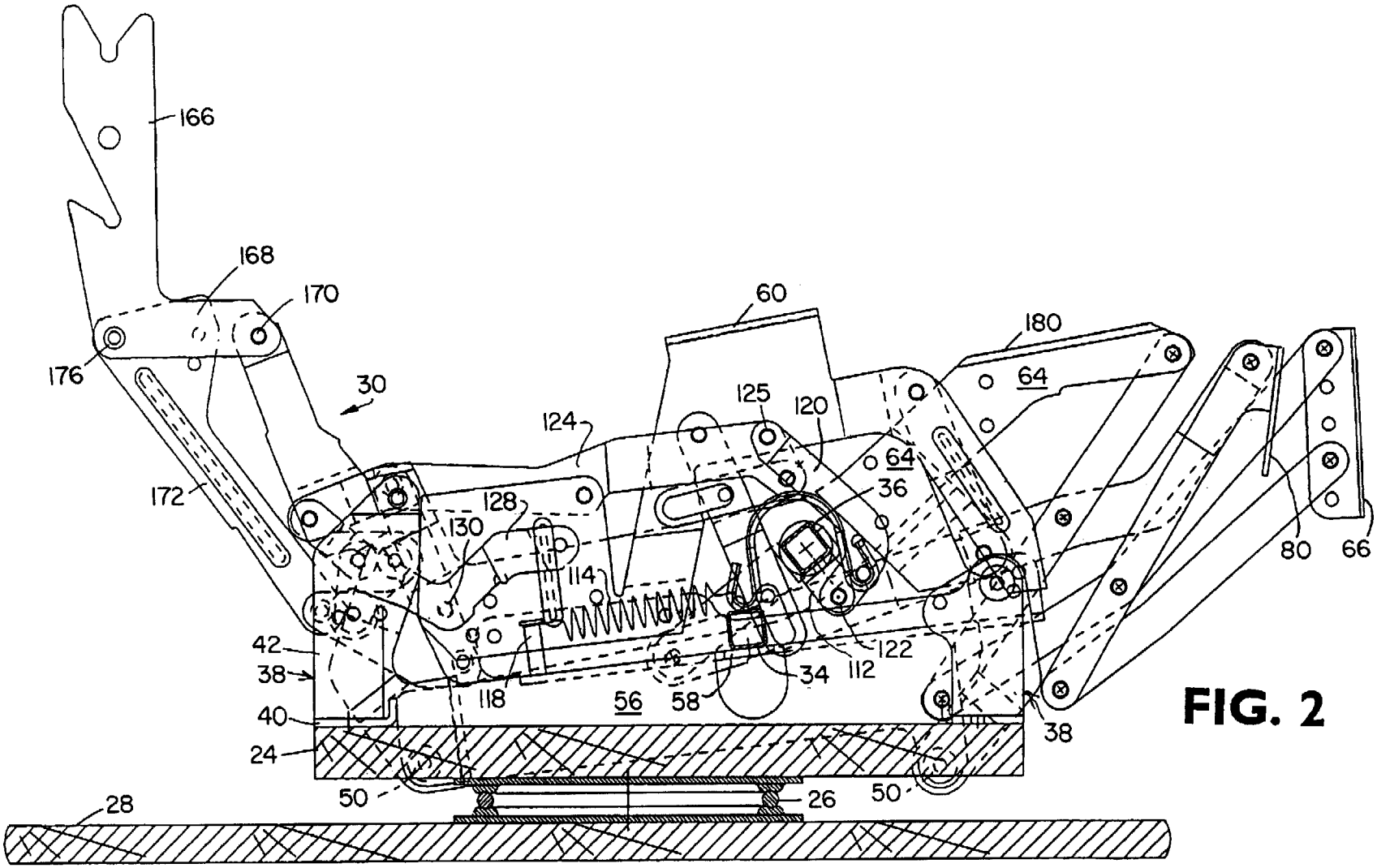
In FIG. 2–16, the upholstered backrest, seat and arm frame unit, and legrest are omitted.
Figure 3:
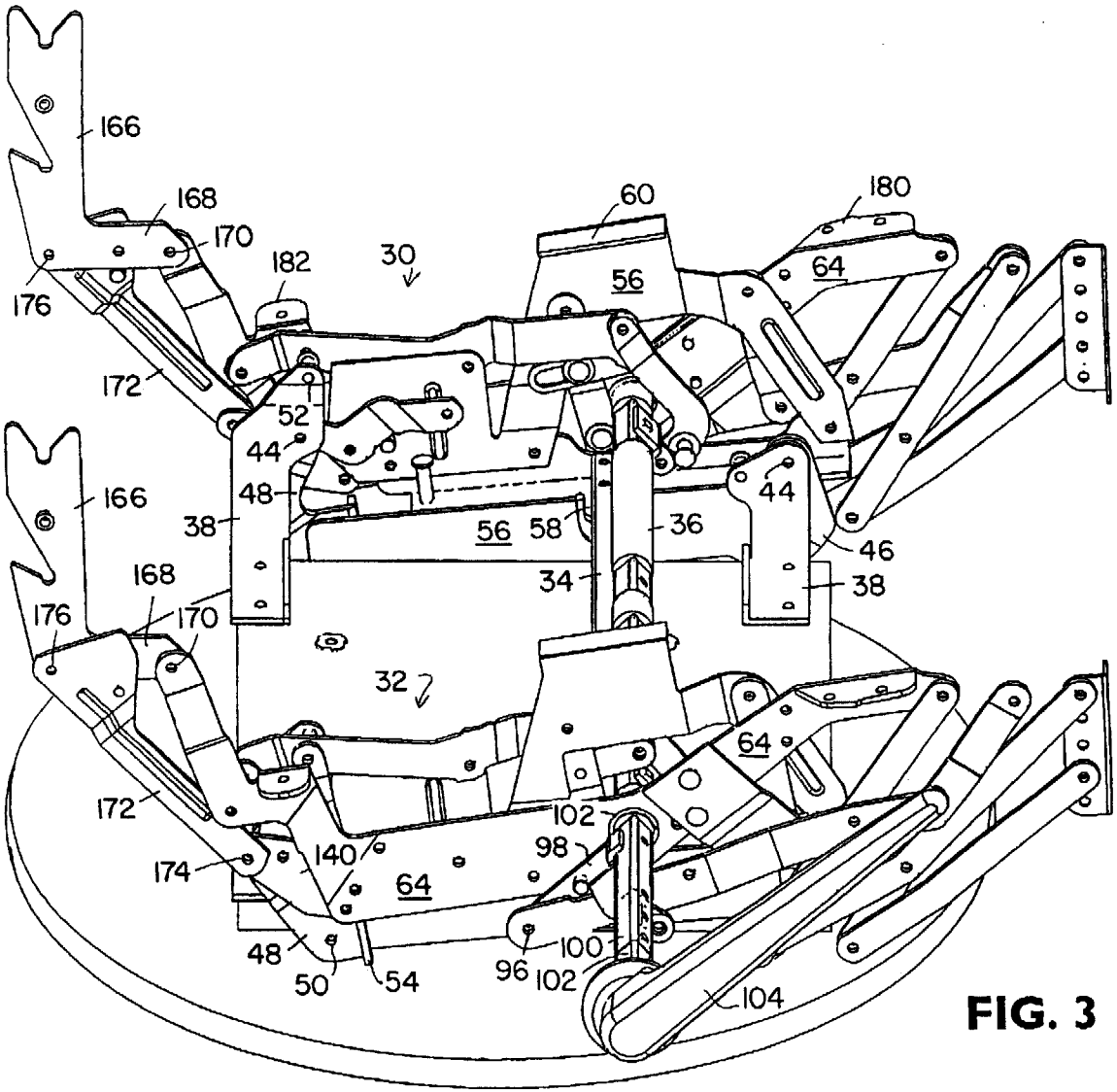
Figure 4:
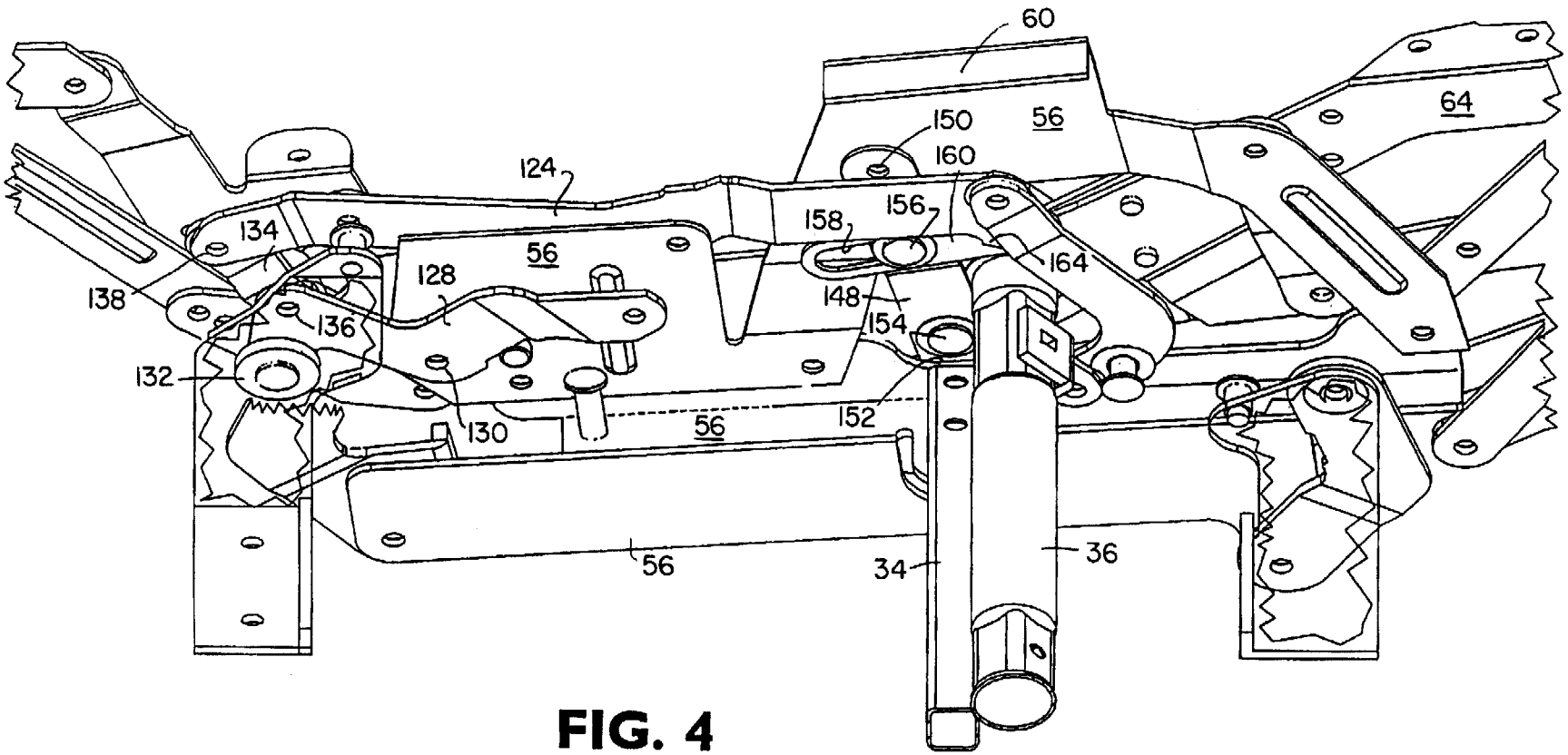
Figure 5:
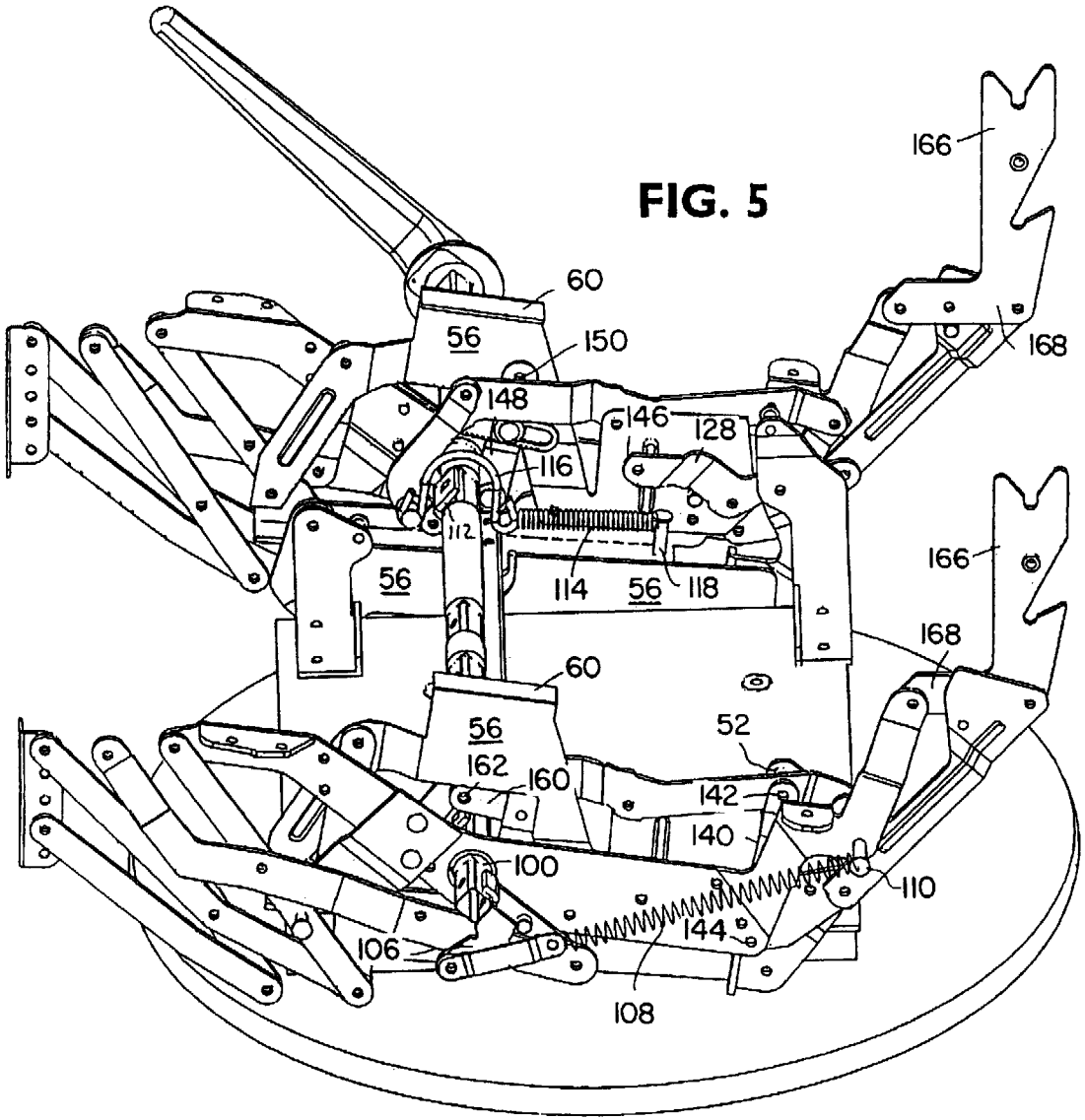
Figure 6:
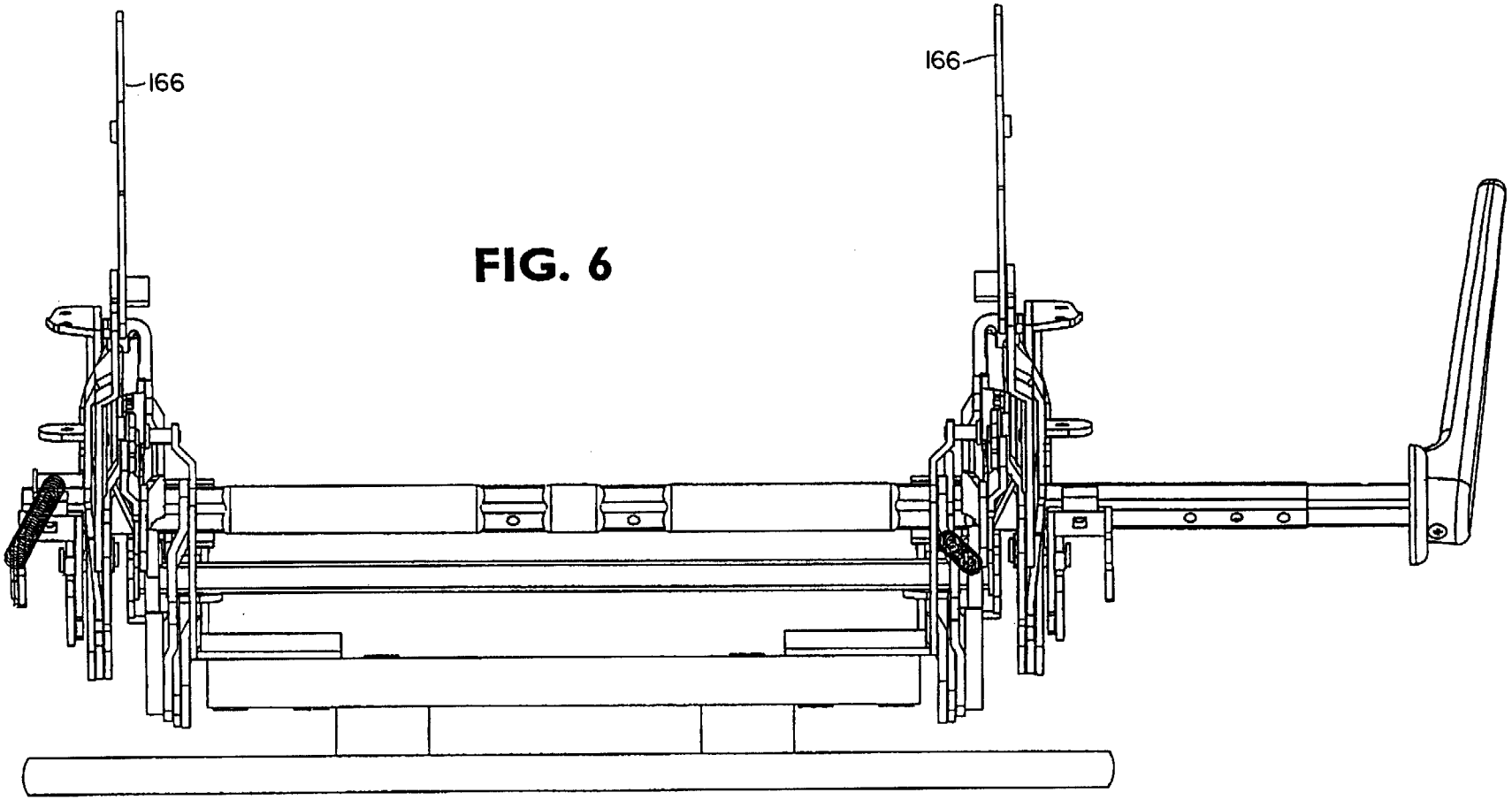
Figure 7:
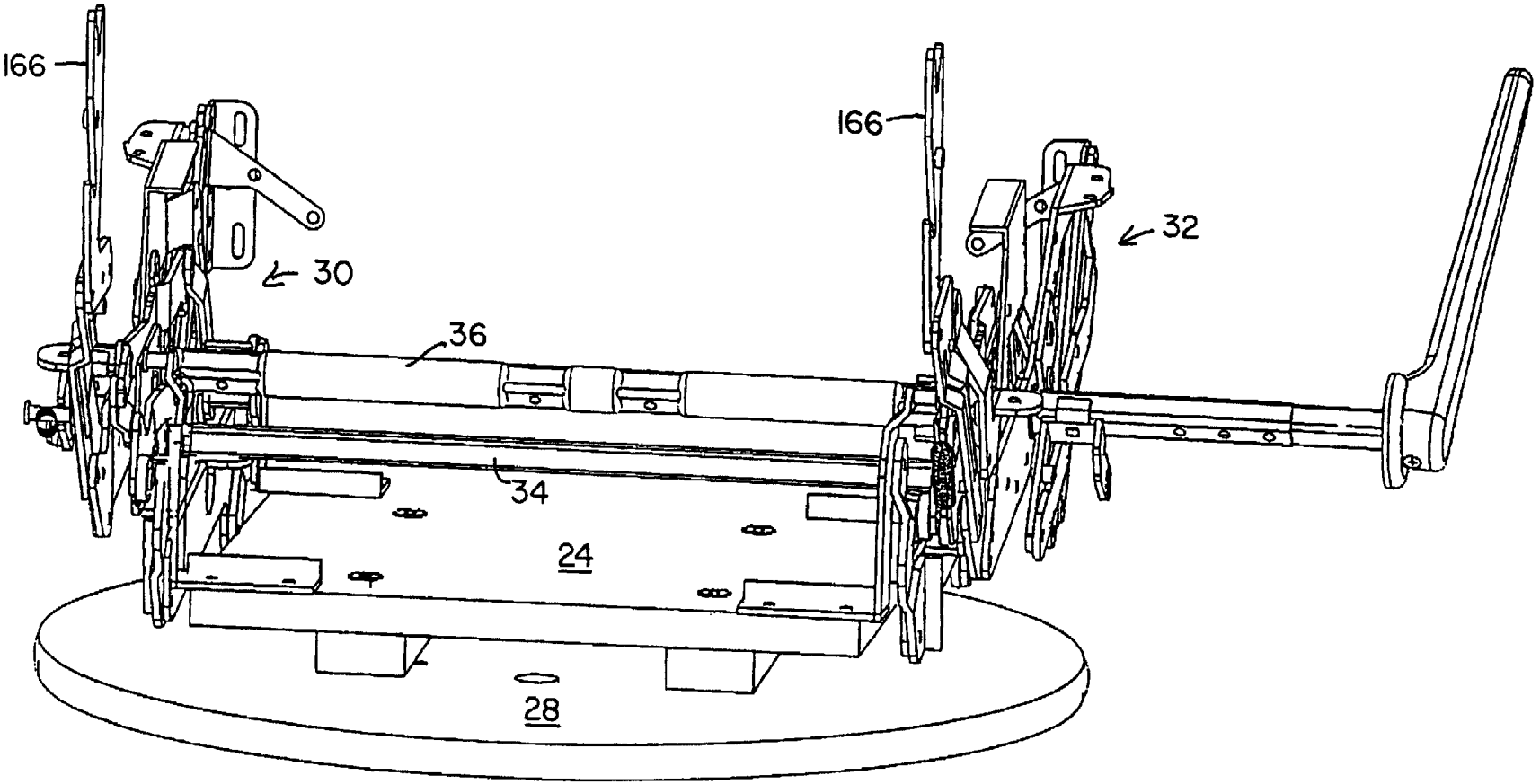
Figure 8:
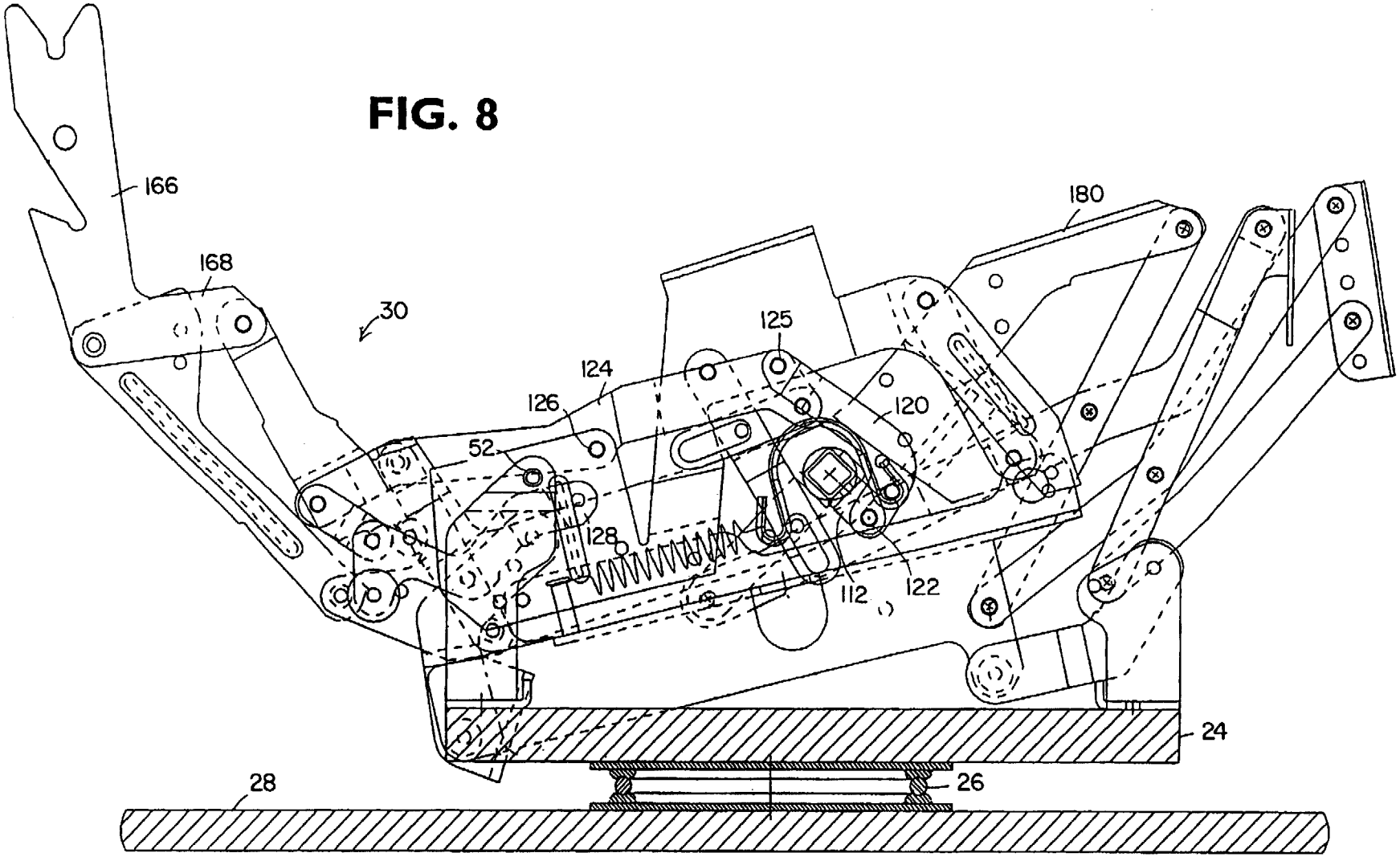
Figure 9:
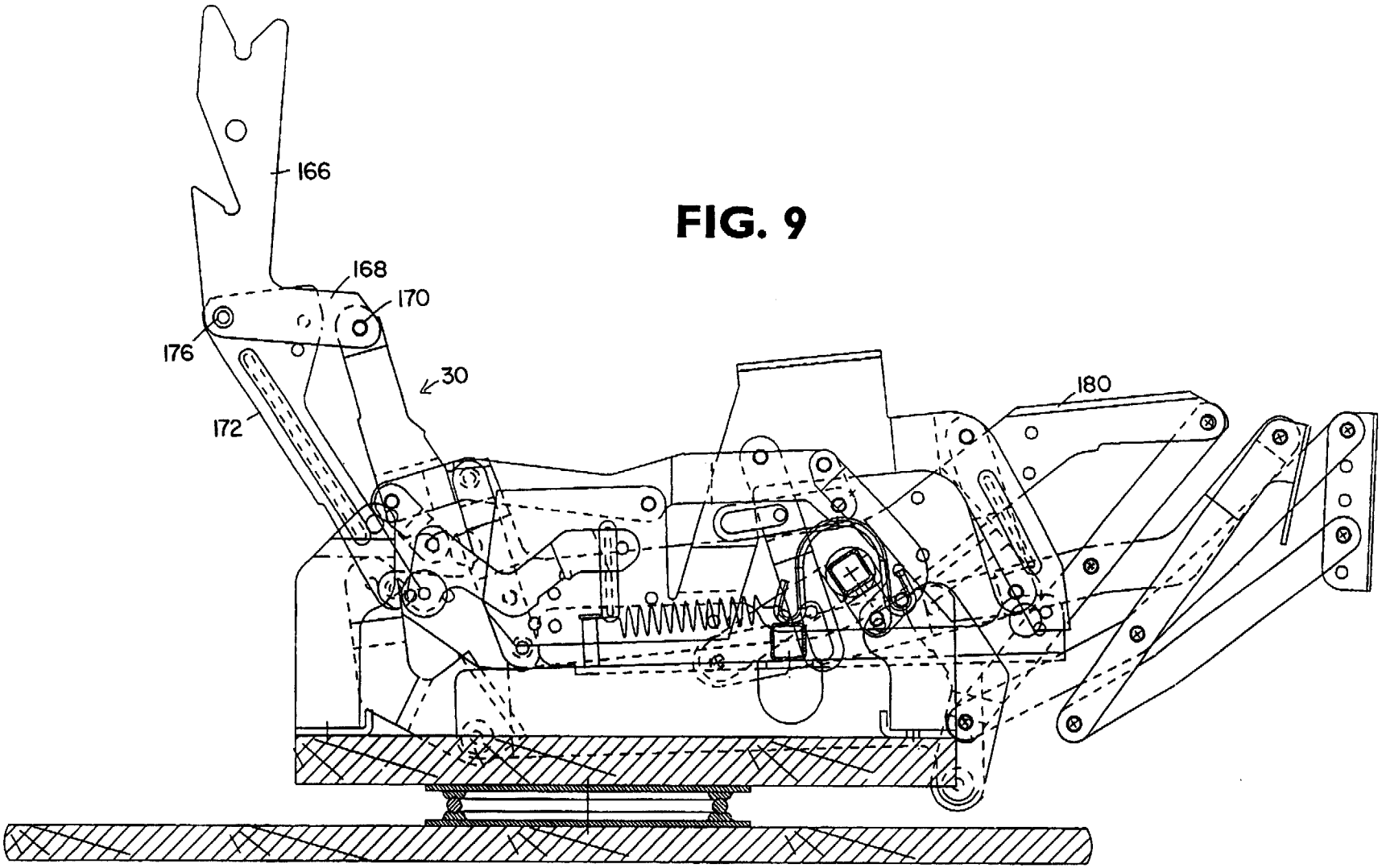
Figure 10:
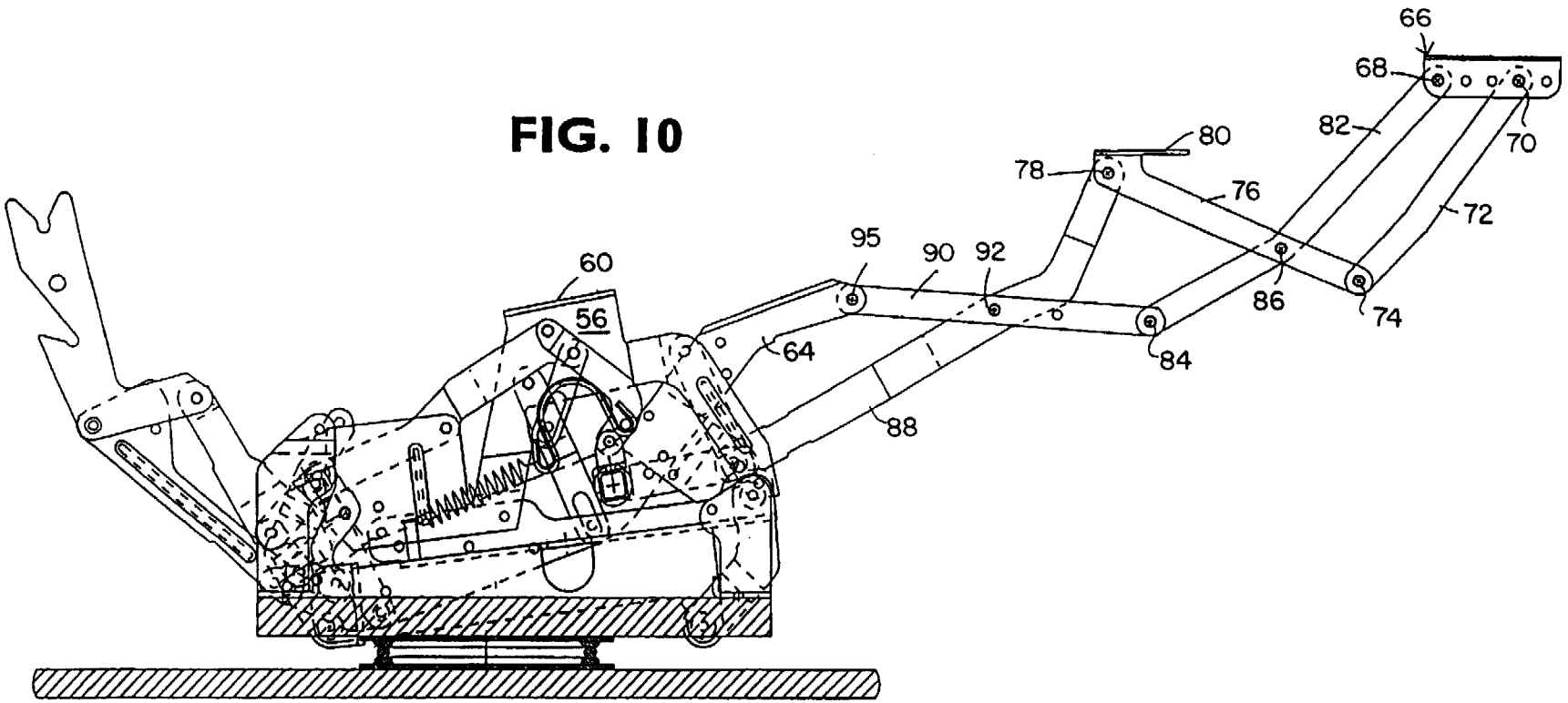
Figure 11:
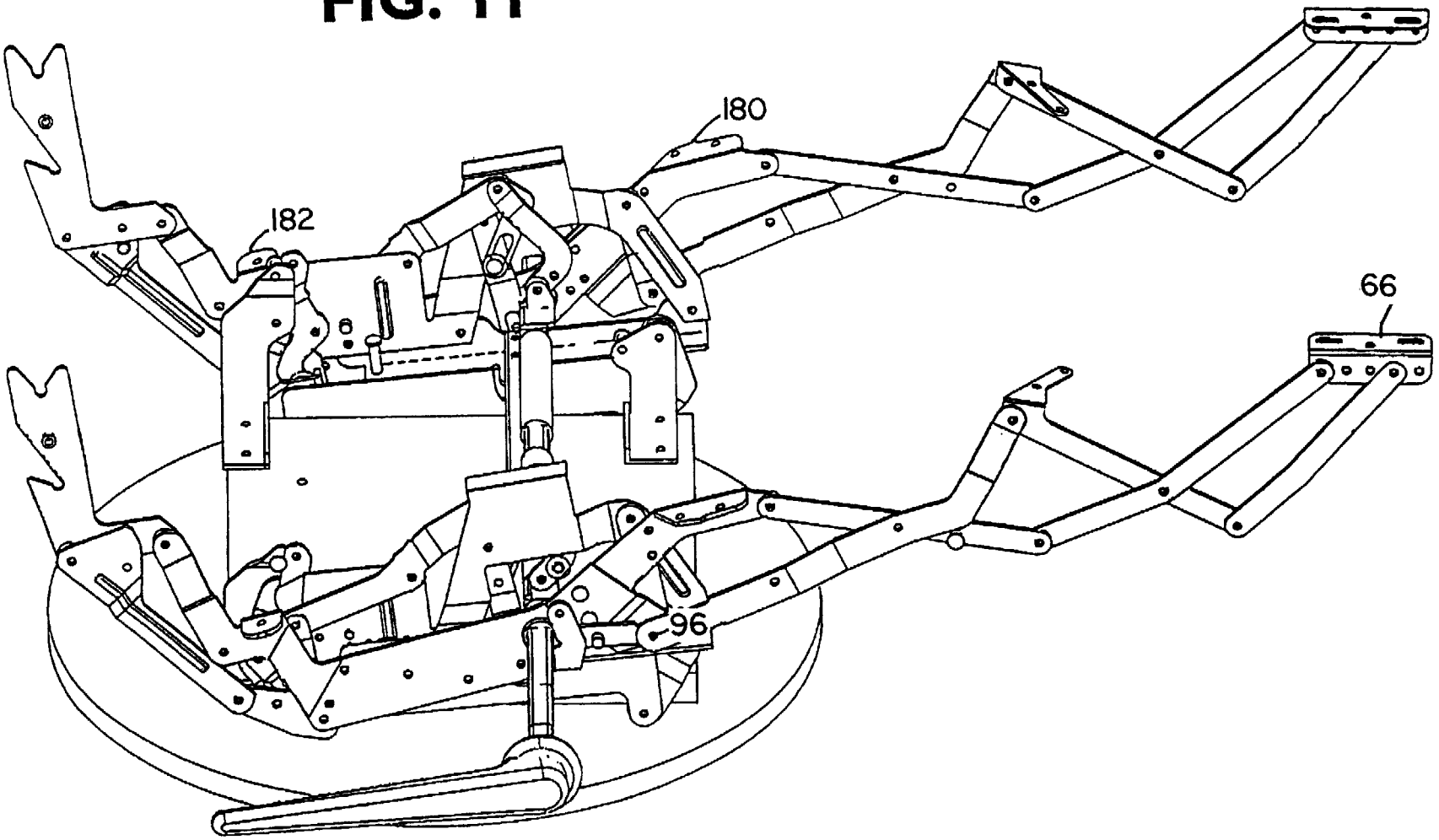
Figure 12:
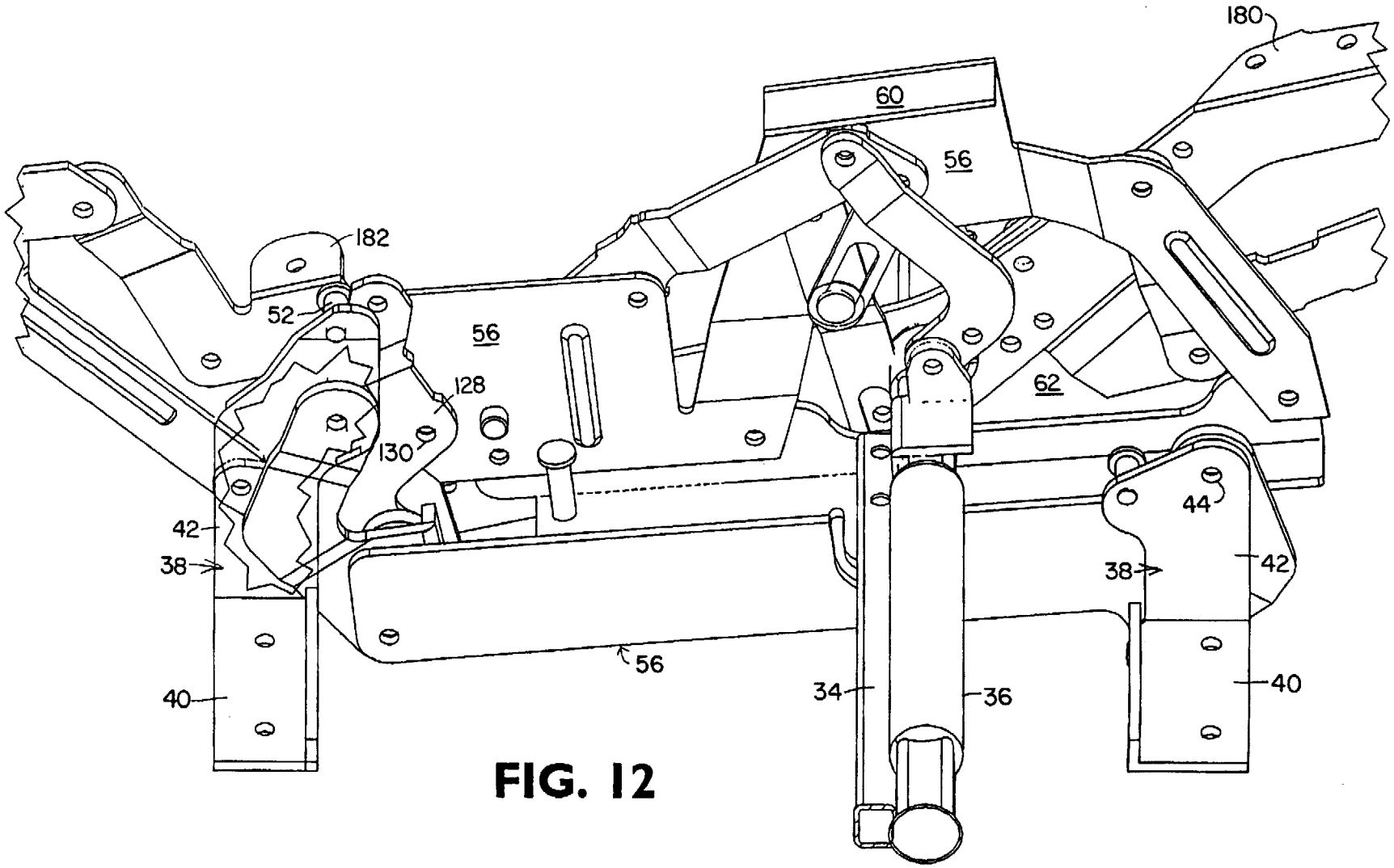
Figure 13:
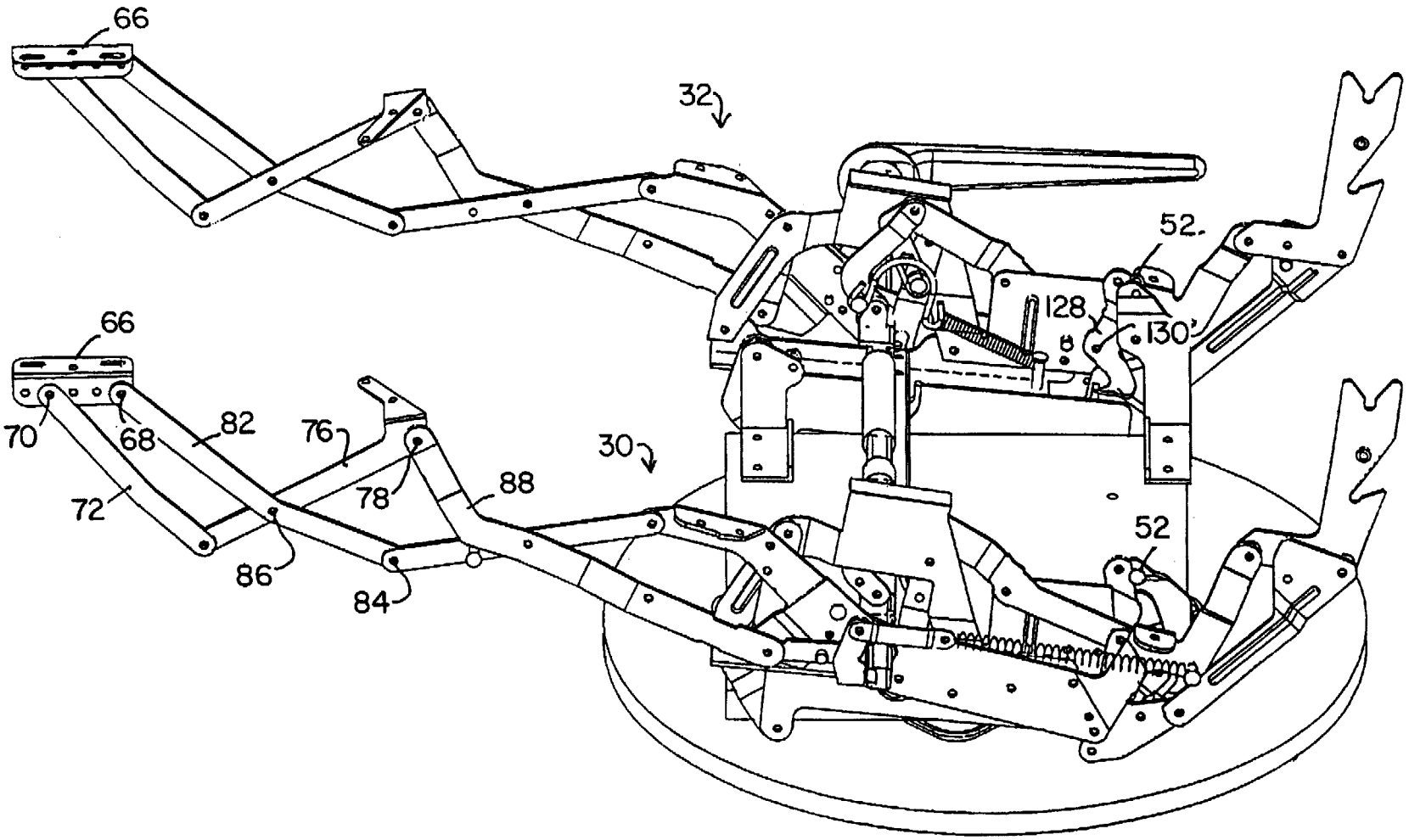
Figure 14:
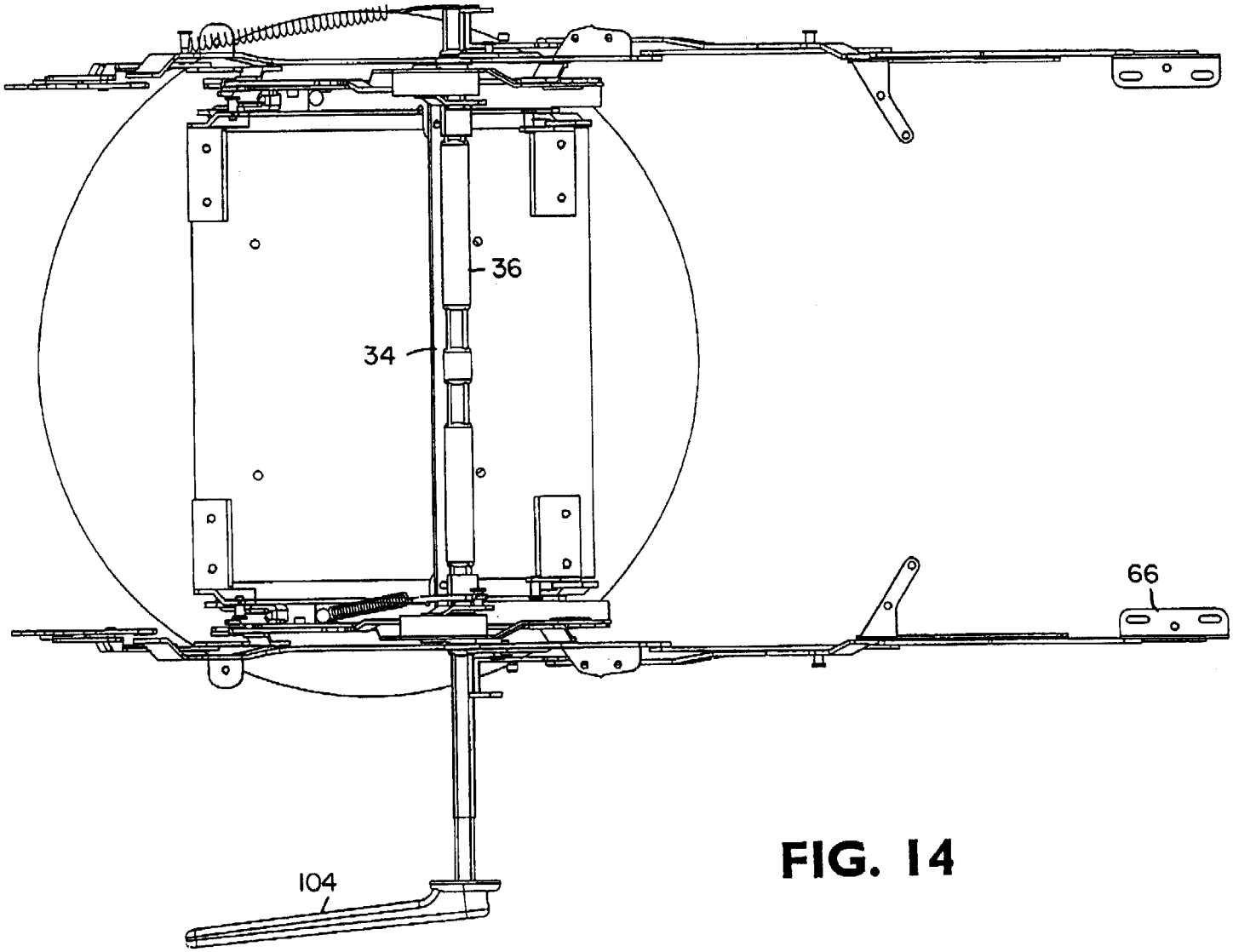
Figure 15:
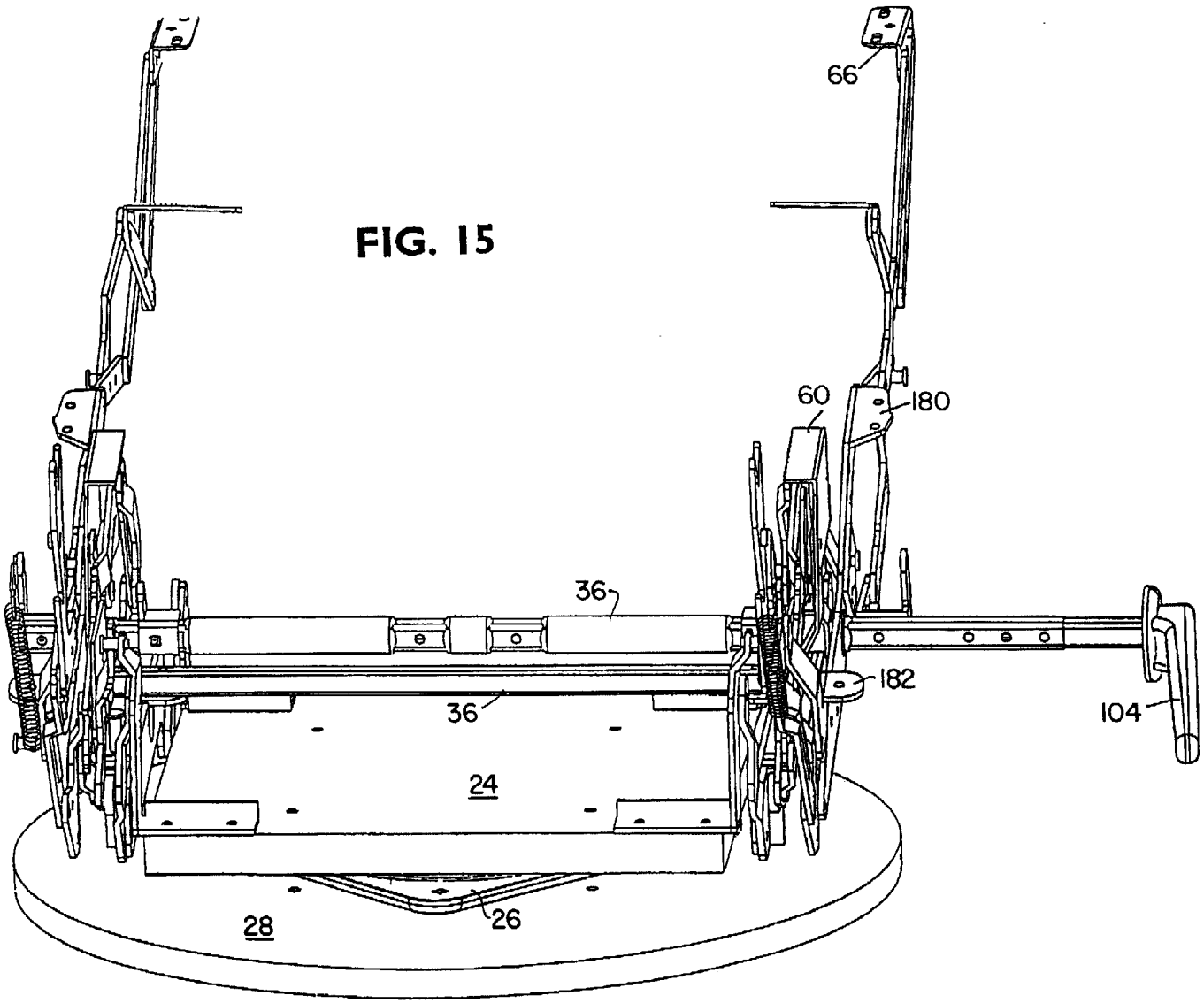

Referring briefly to FIG. 1, the chair 10 of the preferred embodiment is a 3-position gliding reclining chair having a mechanism 12 mounted on a base 14 and having mounted thereon an upholstered seat and arm frame unit 16, an upholstered back 18, and an upholstered legrest, including a primary legrest 20 and a secondary legrest 22. (In the art, an ottoman is a synonym for a legrest.)

In the preferred embodiment, the base 14, is a swivel base which includes an upper, rotary base plate 24, a rotary joint 26 and a lower, stationary base 28. This type of base is well known in the art. In a non-swivel alternative, the features 26 and 28 are omitted, so that the base 14 is provided by an analog of the plate 24, which is stationary in use and may be different in appearance (e.g., be legs or rails or a rectangular plate, or made of metal).

The chair of the invention may be manufactured of conventional materials, using conventional techniques. Thus, the mechanism 12 may be largely made of pieces sheared or punched from steel plate, drilled, bent and painted, e.g., flat black. Fixed connections may be provided by rivets through aligned holes, stops by pins fixed in holes so as to project, and pivots by nut-and-bolt assemblies installed through aligned holes, or by rivets provided with washer-like spaces, e.g., made of steel or nylon provided between the joined links. Unless otherwise indicated or apparent, rivets and pivots provide transverse, horizontal axis joints. The terms left and right, as used, are given from the perspective of a person sitting in the chair. The term medial means at or towards the imaginary vertical centerline plane bisecting the left from the right of the chair, and lateral refers to the direction leftwards or rightwards away from the imaginary vertical centerline plane.

Although in the preferred embodiment, the upper base 24 is made of wood, e.g., a sheet of plywood, it could be fabricated at least in part of steel parts assembled and joined.

For convenience, much of the description will be made in relation to one side of the chair, when in fact but for a few features such as an operating handle (described below) usually provided only on one side, the two sides of the chair are mirror images of one another about the aforementioned imaginary vertical medial plane.

In a left-to-right sense, the terms outboard and outside refer to features that are relatively away from the imaginary vertical medial plane, whereas the terms inboard and inside refer to features that are relatively towards the imaginary vertical medial plane.

The mechanism 12 is preferably manufactured as mirror image left and right side linkages 30, 32 some corresponding elements of which are joined, e.g., by a transverse bar or square-sectioned tube 34 and a torque tube 36. The joining of the side linkages by these features can be accomplished before or after the side linkages are mounted to the chair base.

Also, for convenience in manufacture, parts of the base, e.g., the brackets 38, may be actually preassembled to the mechanism.

The base or upper base plate 24 is shown provided at the left and right, near the front and rear with four L-shaped brackets 38, each having a lower horizontal flange 40 and an outer, vertical flange 42. It is from upper pivot joints 44 provided at the upper ends of the flanges 42 that the mechanism 12 is glidingly, hangingly suspended on the base, by means of forward and rear hanger links 46, 48, via lower pivot joints 50.

The upper and lower pivot joints 44, 50 preferably incorporate annular ball bearing races, so that the pivoting action about the respective pivot axis is especially freely acting. Suitable ball bearing joints are widely commercially available.

The hanger links are preferably short, e.g., so that there is about 4.0 inches (10.2 cm) between the upper and lower pivot joints. The hanger links on the same side of the chair are preferably concavely arcuate toward one another in side profile. The lower pivot joints are preferably about 10.25 inches (25.4 cm) apart, and the upper pivot joints about 2.5 inches (6.4 cm) further apart than the lower pivot joints. In other words, on each side, the lower pivot joints of the glider hanging links are preferably somewhat closer together than are the upper pivot joints.

Above the upper pivot joints, the vertical flanges 42 of the base rear corner brackets 38 are shown having laterally protruding stop pins 52, provided with nylon sleeves, grommets or bumpers.

Forwardly of the lower pivot joint, each rear hanging link includes a medially directed generally vertical stop flange 54.

The remainder of the mechanism 12 could be adapted from a pre-existing mechanism. Some parts shown made of two pieces riveted together, could be fabricated as one piece, and vice versa.

Each side linkage is shown using a main plate 56. It is mainly disposed in vertical planes, with more medial lower portion and a more lateral upper portion, integrally joined at a generally horizontal shoulder, a central part of the lower portion being cut prior to bending the shoulder, so that it remains in the plane of the shoulder to provide a medially directed tab 58.

The transverse bar 34 is secured at its opposite ends to the respective side linkage tabs 58.

In-turned horizontal flanges are centrally provided on upper edges of the plates 56 at 60 to serve as guards to prevent underlying pivoted structure from cutting or interfering with the underside of the seat and arm frame unit.

The rear lower pivot joints 50 of the hanger links 48 mount to rear portions of the lower portions of the main plate 56 and the front lower pivot joints 50 of the hanger links 46 mount to front portions of the lower portions of the main plate 56.

Because the torque tube 36 needs to move forwardly and upwardly relative to the main plates 56 as the chair back is reclined from the TV position to the fully reclined position, relatively large openings 62 are provided through the plates 56, and the torque tube 36 passes transversely of the chair through both of them.

Each side linkage further includes a main carrier link 64 of substantial longitudinal extent.

Each side linkage includes towards its front end a respective pantographic linkage system for mounting a legrest for being thrust (in the TV position) and restricted (in the erect position of the chair). Although only one legrest could be provided, by preference (and as is widely done) the legrest is provided as two elements, namely the primary legrest 20 and the secondary legrest 22.

Referring to the chair as shown with the legrest extended, each pantographic linkage system is shown including (starting from its outer end) a primary legrest mounting bracket 66 having a medially projecting flange and a longitudinal flange having an upper pivot joint 68 and a lower pivot joint 70. A forward lower link 72 has its upper, forward end pivoted to the bracket 66 at 70, and a lower pivot joint 74 provided at its lower, rear end. A forward cross-link 76 has its forward, lower end pivoted to the lower, rear end of the forward, lower link, at 74, and an upper end pivot joint provided at 78. A portion of the upper end of the forward cross-link 76 is bent to extend medially as a flange 80 providing a site for securement thereto of a respective end of the secondary legrest 22.

The forward end of a forward upper link 82 is pivoted to the bracket 66 at 68, crosses on the outer side of the forward cross-link 76, and has a pivot joint 84 provided at its lower, rear end. Where the links 76 and 82 cross, they are pivotally joined by a pivot joint 86.

A rear upper link 88 and a rear cross-link 90 cross at 92, where they are pivotally joined. The lower, forward end of the rear cross-link is pivoted to the lower rear end of the forward upper link 82 at 84. The forward, upper end of the rear upper link 88 is pivoted to the upper, rear end of the front cross-link 76 at 78.

The upper, rear end of the rear cross-link 90 is pivoted to the front end of the main carrier link 64 by a pivot joint 95.

The lower, rear end of the rear upper link 88 is pivotally joined by a pivot joint 96 to the radially outer end of a crank link 98, the radially inner end of which is secured on a stub 100 of the torque tube 36 which projects out through an annular nylon bushing 102 in which the torque tube is journalled in a respective hole through the main carrier link 64.

Either of the stubs 100 has the handle tube 102 of a crank handle 104 telescoped onto it through a grommeted opening (not shown) provided through the respective side of the seat and arm frame unit 16.

Manual angular rotation of the handle 104 about the axis of the torque tube 36 angularly rotates the crank link 98, thereby causing the pantographic linkage systems to project (thrust), when the handle is rotated in one direction, and to retract, when the handle is rotated in the opposite direction.

In order to prevent a legrest from failing to fully retract into a stowed condition when a user pulls back on the primary legrest with his or her heels and/or rotates the handle 104 in the appropriate direction, it is convention to provide helper springs. These are usually tension coil springs secured between appropriate structures. They can, but need not be provided on both side linkages, and even if provided on both sides, need not be the same on the handle side as on the non-handle side. For instance, in the example depicted, a first short radial bracket 106 provide on the outer stub 100 on the non-handle side mounts at its radially outer end the front end of a tension coil spring assembly 108 the rear end of which is hooked onto a laterally projecting pin 110 providing on an intermediate height rear end portion of the main carrier link 64. And, a second short radial bracket 112 is secured on the torque tube closely inboard of the handle side linkage. A tension coil spring assembly 114 has its forward end (via an arching link 116 secured to the radially outer end of the bracket 112) and its rear end hooked onto an upwardly projecting pin 118 based on the horizontal shoulder of the main plate 56.

Moving the chair from the erect position shown in FIGS. 2–9 to the TV position shown in FIGS. 1 and 10–15, extends the legrest-mounting pantographic linkage systems and resultantly stretches the springs 108 and 114. As the legrest is stowed, the springs 108 and 114 recover, to cause complete stowing of the legrest (i.e., complete movement from the FIGS. 1 and 10–15 position, to the FIG. 2–9 position).

As can be seen, when the chair is in its erect position shown in FIGS. 2–9, nothing (but friction and gravity, the effects of which are minimized) prevent free glidability of the chair relative to the base by swinging of the forward and rear hanging links 46, 48. The glide-preventing lock structure provided in the chair of the present invention is entirely out-of-the-way, disengaged and inactive. However, this glide-preventing lock structure is activated and moves into the way and becomes engaged as the chair is actuated to move from its erect position of FIGS. 2–9, to its TV position of FIGS. 1 and 10–15, and inactivated again as the chair is actuated to move back to the erect position.

At this stage, more of the glide-preventing lock structure needs to be described, so that its structure and manner of operation can be more readily understood.

As shown, one of the second short radial brackets 112, is also provided on the torque tube 36 next to the non-handle side linkage.

Operators for the locks are mounted to and operated by arcuate movement of the outer ends of these brackets 112 as the torque tube 36 is rotated (by rotating the handle 104 or the user's pulling back on the primary legrest using his or her heels). The operators for the glide-preventing locks are shown each including a downwardly, rearwardly concavely arcuate crescent link 120 having its forwarded end pivoted to the radially outer end of the bracket 112 at a pivot joint 122 which may be the same, on the handle side, as is used by the crescent link 116 of the front end of the spring assembly 114. The upper, rear end of the crescent link 120 is pivoted by a pivot joint 125 to the forward, upper end of a long longitudinal link 124 which is pivoted at an intermediate site along its length, by a pivot joint 126 to an upper intermediate portion of the main plate 56. A lock carrier link 128 is provided which is generally concavely arcuate upwards (in side elevational profile). Intermediate its forward and rear ends, it is pivotally mounted on the medial side of the main plate 56 by a pivot joint 130 in the lower rear portion of the main plate 56. The rear end of the lock carrier link 128 is provided with a downwardly projecting dogleg-like stub having a medially projecting pin on which is mounted a nylon bushing 132, as part of a lower lock. The forward, upper end of the lock carrier link 128 serves as part of an upper lock. A short connecting link 134 is provided having pivot joints 136, 138, respectively, provided at its upper, rear and lower, forward ends. The joint 136 connects the connecting link 134 to the knee of the dogleg stub at the rear end of the lock carrier link 128. The joint 138 connects the connecting link 134 to the rear end of the long longitudinal link 124.

The main longitudinal link 124 also is pivotally connected to the main carrier link 64 at a rear lower portion of the latter, by the forward leg of an upright, V-shaped connecting link 140 having a pivot joint 142 at the upper end of the forward leg connecting with the link 124 somewhat forwardly of the joint 138, and a pivot joint 144 at its lower, apex end connecting with the link 64.

Accordingly, as the handle 104 is turned for thrusting the legrest, the rotation of the torque tube 36 raises the forward end, and, thus, the rear end of the link 120, thus raising the front end of the link 124, causing it to pivot about the joint 126, thereby lowering the rear end of the link 124, thereby, via the link 134, depressing the dogleg stub of the link 128, causing the link 128 to pivot about the joint 130. This latter pivotal motion translates the pin-mounted bushing 132 into engagement with the rear face of the medially projecting stop flange 54 on the rear hanger link, thus locking the lower lock 132, 54 and, simultaneously, swinging the edge of the forward end portion 146 of the lock carrier link 128 upwards and rearwards into engagement with the front side of the nylon-sleeved lock pin 52, thus locking the upper lock 146, 52.

Some guided lost motion connection is provided among the lock operating linkage, the main plate 56 and the main carrier link 64 just to the rear of the location of the torque tube 36. In the preferred embodiment, this guided lost motion connection is shown including a generally vertical link 148 which has a pivot joint 150 at its upper end pivoted to the main plate 56. This link 148 has a longitudinally elongated slot 152 near its lower end which slidingly receives a pivot joint 154 for slidingly pivotally connecting the lower end of the link 148 to the main carrier link 64.

Intermediate its ends, the link 148 is provided with a third pivot joint 156 which extends through a longitudinal slot 158 provided in the lower end of a short link 160. The upper end of the short link 160 is provided with a pivot joint 162 connecting it to a downwardly, forwardly projecting dogleg stub 164 on the link 124.

When the chair is in its erect position of FIGS. 2–9, the pin of the pivot joint 156 is at the forward end of the slot 158 and the pin of the pivot joint 154 is at the upper end of the slot 152. As the legrest extends and the locks are set, the pin of the pivot joint 156 slides to the lower end of the slot 158 and pin of the pivot joint 154 becomes located at the lower end of the slot 152.

Figure 16:
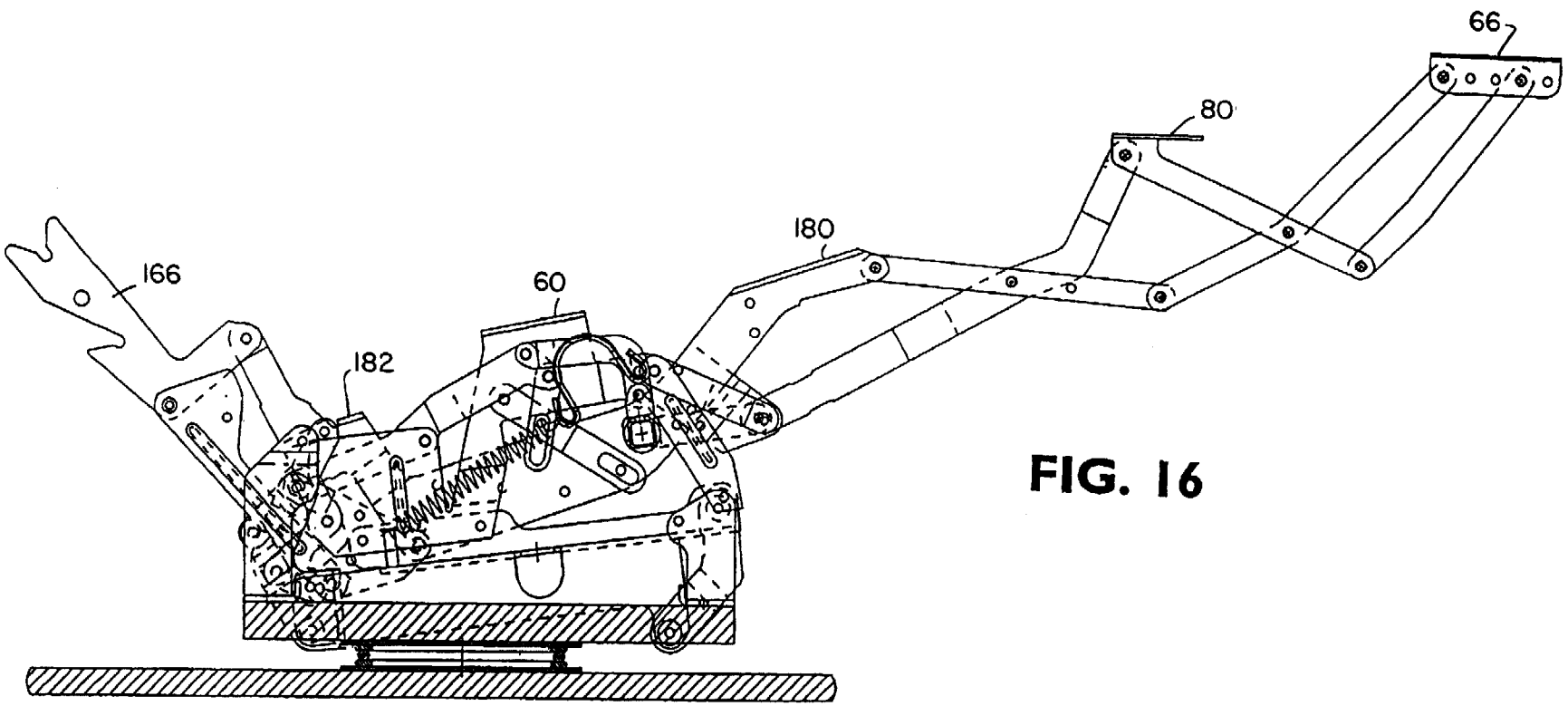

Then, as the chair is moved from its TV position of FIGS. 1 and 10–15, to its fully reclined position of FIGS. 16, caused by the user leaning back on the upper part of the chair back 18 while seated in the chair, the V-shaped links 140, at the rear, pivot forwardly and upwardly about the pivot joints 142 and 144, and the pins of the joints 156 move towards the upper ends of the slots 158, as the links 148 pivot about their upper end pivot joints 150.

The back-mounting parts of the side linkages are typical:

The back 18 is secured at the lower end of its side to the upper, more vertical leg 166 of an L-shaped link, the forwardly projecting, lower, more horizontal leg 168 of which has a pivot joint 170 pivotally connecting it to the upper end of an upwardly and rearwardly projecting spur on the main carrier link 64. An oblique connecting link 172 is provided having a lower pivot joint 174 at its lower, forward end connecting with the upper end of the rear leg of the V-shaped link 140, and an upper pivot joint 176 connecting with the apex of the L-shaped link, at the juncture of the legs 166, 168.

A protective flap 178, e.g., made of stiffly flexible black plastic is secured into the pivot joints 176, 170 on the outside of the side linkage, for preventing possible damage or injury.

As the user, seated in the chair when the chair is in the TV position, pushes their back against the upper part of the back of the chair, the chair back 18 reclines, cocking the L-shaped link 166, 168 backwards, causing the pivot joint 176 to push down and forwards, pushing the connecting link 172 forwards and upwards, pushing the main carrier link upwards and forwards, together with structures mounted on the main carrier link (including the seat and arm frame unit, which is mounted onto the mechanism 12, by being secured onto the out-turned mainly horizontal flange 180, 182 provided on forward and rear upper edge portions of the main carrier link 64).

Movement of the chair from its TV position to its fully reclined position and back to its TV position leaves the upper and lower locks set, as described above, but as the user turns the handle 104 and/or pulls back on the primary legrest with their heels, the legrest mounting mechanism retracts, causing the lock carrier link 128 to pivot about the pivot joints 130, disengaging the upper and lower locks, and, thus, re-establishing the capability of almost effortless gliding in the erect position of the chair.

It should now be apparent that the gliding reclining chair as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

I claim:

1. A gliding reclining chair, comprising:

a base;

a mechanism supported on the base;

the base including left and right side linkages having a plurality of corresponding elements, including left and right main plates and left and right main carrier links; a transverse bar laterally interconnecting said main plates for coordinating longitudinal movement of said side linkages relative to said base; and a torque tube journalled for rotation in and laterally interconnecting said main carrier links for coordinating operation of said left and right side linkages;

said left and right side linkages including respective pantographic linkage systems for extending and retracting a legrest;

a legrest mounted on said pantographic linkage systems for extension and retraction;

said pantographic linkage systems each having two rear links respectively based on said main carrier link and said torque tube, for extension and retraction upon rotation of said torque tube about its own longitudinal axis respectively in one angular direction and in an opposite angular direction;

a seat and arm frame unit mounted on said main carrier links;

a seat back articulated to the main carrier link by side linkage elements permitting movement of the seat back between an erect position and a reclined position;

said side linkages including respective pluralities of interpivoted links mounting said main carrier links on said main plates for tilting the main carrier links downwards to the rear relative to the main plates upon extension of the legrest, and back upwards upon retraction of the legrest, and for translating the main carrier links upwardly and forwardly relative to said main plates upon reclining of said chair back, and downwardly and rearwardly upon erecting of said back;

each side linkage further including front and rear generally vertical hanger links having respective upper, transverse, horizontal axis pivot joints pivotally connecting to said base, and respective lower, transverse, horizontal axis pivot joints pivotally connecting to respective ones of said main plates, thereby mounting said mechanism on said base for gliding motion relative to said base;

said base and each side linkage cooperatively further including a lower lock and upper lock, each including a first fixed position lock element on said base and a second lock element on a moveable lock link of each said side linkage, respective of lock elements being engageable for preventing said gliding motion and disengageable for permitting said gliding motion;

said left and right side linkages further including respective interpivoted links articulated to move said lock links in one direction to engage said upper and lower locks, and in an opposite direction to disengage said upper and lower locks.

2. The gliding reclining chair of claim 1, wherein:

each said moveable lock link has said second lock elements thereof located at opposite ends thereof, and is pivoted to the respective main plate intermediate said opposite ends, and articulated to the respective pantographic linkage system for rotation from a generally horizontal position to a generally vertical position for engaging said locks, and from said generally vertical position to said generally horizontal position for disengaging said locks.

3. The gliding reclining chair of claim 1, wherein:

said upper and lower pivot joints of said hanger links are ball bearing joints.

* * * * *